United States Patent [19]

Wheatley et al.

[11] Patent Number: 4,751,882

[45] Date of Patent: Jun. 21, 1988

[54] ARTICULATED LIGHTWEIGHT PIGGYBACK RAILCAR

[75] Inventors: Thomas W. Wheatley, Westmount; Kelly J. Arrey, Montreal, both of Canada

[73] Assignee: Canadian National Railway Company, Montreal, Canada

[21] Appl. No.: 836,987

[22] Filed: Mar. 6, 1986

[51] Int. Cl.[4] ..... B60F 1/00; B65D 17/10

[52] U.S. Cl. ..... 105/4.1; 105/416; 105/421; 105/462; 105/199.3; 410/7; 410/65

[58] Field of Search ..... 105/3, 4.1, 355, 404, 105/413, 414, 415, 416, 421, 199.3, 462; 410/4, 7, 56, 65

[56] References Cited

U.S. PATENT DOCUMENTS

| | | | |
|---|---|---|---|
| 689,833 | 12/1901 | Sage | 105/421 |
| 1,120,923 | 12/1914 | Frede | 105/462 X |
| 3,371,622 | 3/1968 | Lich | 105/4.3 |
| 3,509,829 | 5/1970 | Henriksson et al. | 105/368 |
| 3,716,146 | 2/1973 | Altherr | 213/67 R X |
| 3,721,199 | 3/1973 | Hassenauer | 105/366 A |
| 4,191,107 | 3/1980 | Ferris et al. | 105/4.1 |
| 4,233,909 | 11/1980 | Adams et al. | 105/4.1 |
| 4,258,628 | 3/1981 | Altherr | 105/4.3 |
| 4,274,776 | 6/1981 | Paton et al. | 105/414 X |
| 4,386,880 | 6/1983 | Schimmeyer | 410/56 |
| 4,516,506 | 5/1985 | Paton | 105/3 |

*Primary Examiner*—Johnny D. Cherry
*Assistant Examiner*—Russell D. Stormer
*Attorney, Agent, or Firm*—Larson and Taylor

[57] ABSTRACT

An articulated railcar for transportation of highway trailers is lightweight and has a deck height which permits heavy highway trailers to be carried without exceeding the maximum allowable center of gravity height above the top of the rail. The railcar comprises a plurality of car bodies positioned end to end witharticulated connections therebetween, each car body having a skeleton structure with a depressed center sill extending centrally for the length of the car body, the center sill having goose neck projections at each end, with the ends of the center sill at a higher elevation than the remainder of the center sill, end sills at each end of the center sill extending perpendicularly from each side of the center sill, the end sills adjoining the articulated connections, body side bearing pads located on the underside of each of the end sills, the body side bearing pads offset longitudinally from a plane representing the end of the center sill towards the adjoining articulated connection, a plurality of truck assemblies with wheels, the truck assemblies positioned below the articulated connections to support the adjoining ends of the car bodies and having truck side bearings located below the body side bearing pads, the articulated connections comprising connectors mounted on each of the truck assemblies for connecting the adjoining ends of the car bodies together, and for pivotally supporting the adjoining ends of the car bodies on each of the truck assemblies.

9 Claims, 5 Drawing Sheets

ARTICULATED LIGHTWEIGHT PIGGYBACK RAILCAR

BACKGROUND OF THE INVENTION

The present invention relates to an articulated railcar for the transportation of highway trailers. The railcar is lightweight and has a low deck height which permits heavy highway trailers to be carried without exceeding the maximum allowable center of gravity height above the top of the rail.

Piggyback railcars wherein highway trailers sit on flat railcars, are used extensively on today's railways. An existing flat car has a deck approximately 44 inches above the top of the rail. The combined trailer and railcar center of gravity has an accepted maximum level of 98 inches above the top of the rail, and in order to keep within this maximum level, there is a weight restriction on the trailer of approximately 70,000 lbs. Trailer weights in excess of this raise the combined center of gravity above the accepted maximum level.

SUMMARY OF THE INVENTION

The present invention provides a railcar with a low slung skeleton frame having a depressed deck or platform for highway trailer wheels so that the height of the highway trailer above the rails is reduced. Thus heavier trailers can be carried on the railcar of the present invention without exceeding the accepted maximum level. The railcar is a lightweight construction and thus reduces manufacturing costs. The railcar is articulated with preferably three or five platforms or car bodies for highway trailers. The length of the highway trailers may be varied, but are designed to sit on the skeleton lightweight frame having a center sill extending along the center of the car body.

The present invention provides an articulated railcar comprising: a plurality of car bodies positioned end to end with articulated connections therebetween, each car body having a skeleton structure with a center sill extending centrally for the length of the car body, the center sill having goose neck projections at each end, with the ends of the center sill at a higher elevation than the remainder of the center sill, ends sills at each end of the center sill extending perpendicularly from each side of the center sill, the end sills adjoining the articulated connections, body side bearing pads located on the underside of each of the end sills, the body side bearing pads offset longitudinally from a plane representing the end of the center sill towards the adjoining articulated connection, a plurality of truck assemblies with wheels, the truck assemblies positioned below the articulated connections to support the adjacent ends of the car bodies and having truck side bearings located below the body side bearing pads, the articulated connections comprising connector means mounted on each of the truck assemblies for connecting the adjoining ends of the car bodies together, and for pivotally supporting the adjoining ends of the car bodies on each of the truck assemblies.

In one embodiment the end sills have a gull wing shape extending from the center sill in an upward plane, and in an end plane towards the adjoining articulated connection. In a second embodiment, the end sills each comprise a straight web extending from each end of the center sill, the web having a top plate, and a bottom plate bent to meet the center sill bottom, and each of the body side bearing pads extend at an angle from beneath the bottom plate over the truck side bearings.

In another embodiment, the car bodies are adapted to support highway trailers and include a hitch assembly above one end of the center sill, and a trailer wheel platform supported on cross bearers attached to both sides of the center sill, the platform being below the top of the center sill. The hitch assembly is designed so that it can be relocated with a minimum of shop work on the center sill to accomodate longer trailers. In another embodiment, three or five car bodies are joined together with articulated connections between the adjoining ends of the car bodies.

In a still further embodiment, the center sill comprises a welded box structure with a top plate having a greater sectional area than a bottom plate, such that the centroid of the center sill is located as close to coupling height of the railcar as possible.

BRIEF DESCRIPTION OF THE DRAWINGS

In drawings which illustrate embodiments of the invention:

FIG. 3 shows a top plan view of the car body shown in FIG. 2;

DETAILED DESCRIPTION OF THE DRAWINGS

Figure 1:
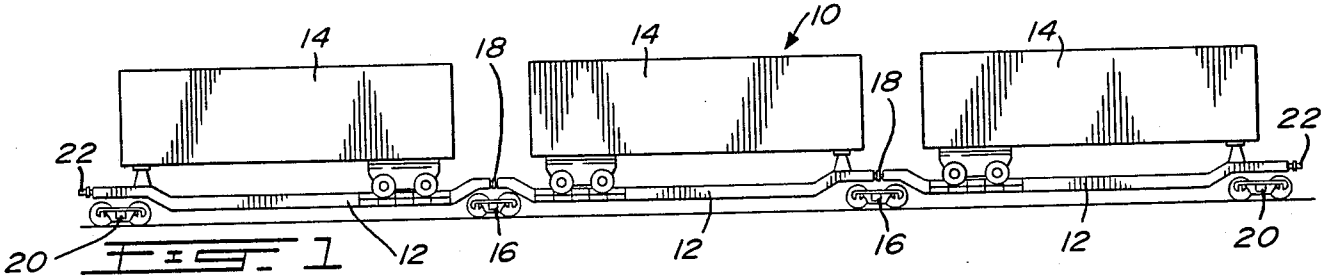
FIG. 1 shows a side view of an articulated railcar according to one embodiment of the present invention.
Figure 5:
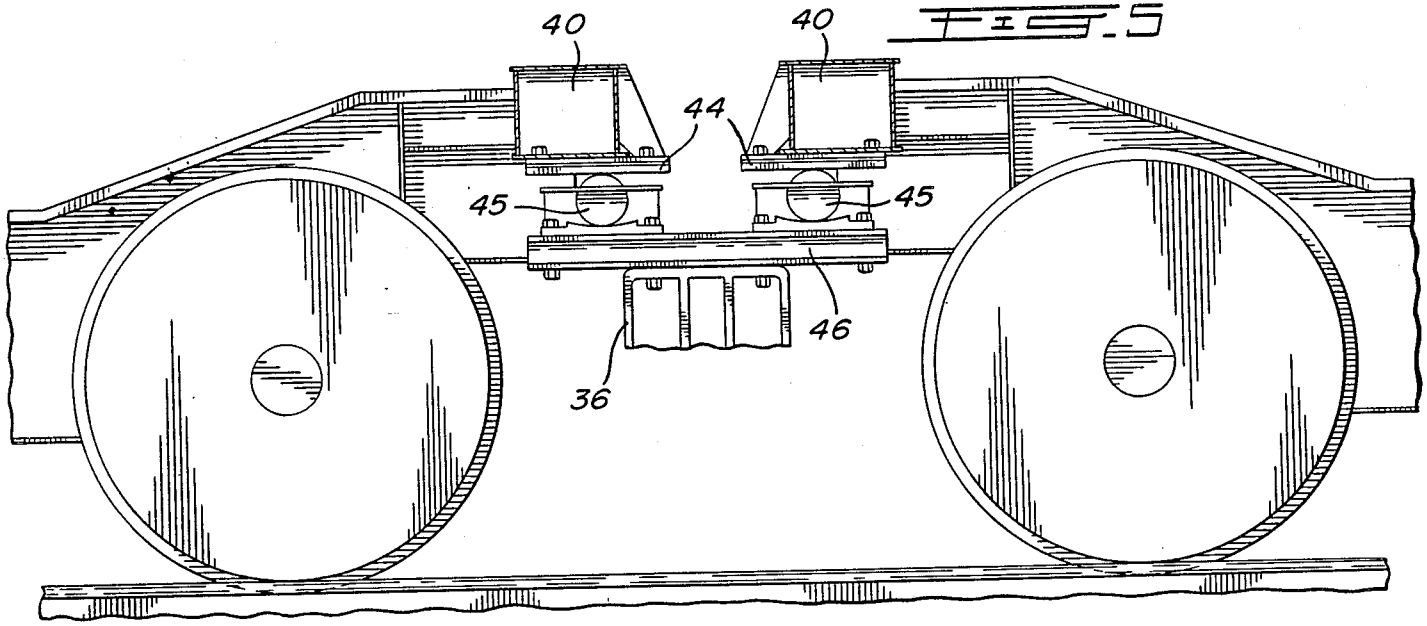
FIG. 5 shows a side sectional view taken at line 5—5 of FIG. 4 showing the side bearings at the end sills of adjacent car bodies.

An articulated rail car 10 is shown in FIG. 1 having three car bodies 12 supporting three highway trailers 14. Whereas three car bodies 12 are shown herein, the preferred number of car bodies to make up a single articulated railcar is three or five. Center truck assemblies 16 are placed between the center car body 12 and the two exterior car bodies 12 with an articulated connection 18 joining the car bodies 12 together. End trucks 20 are positioned at the outside ends of the two exterior car bodies 12 supporting the ends of the car bodies 12 and having a standard coupling 22 for connection to other railcars or a locomotive.

Details of one car body 12 are illustrated in FIGS. 2 to 6. Each car body 12 has a center sill 30 formed of a welded box frame extending in the center for the full length of the car body. The center sill 30 has goose neck projections 32 at each end sloping upwards to raised ends 34. The goose neck projections 32 provide a depressed or low slung center portion of the center sill 30. The raised ends 34 of center sills 30 on adjacent car bodies 12 are joined together at an articulated connection 18 supported on a truck bolster 36 formed integral with the center truck assembly 16. The articulated connection 18 while not detailed herein, may be a connector device of the type which includes conventional male and female connector elements connected to the same center pin. One type of connector device suitable for use in the present invention is that type manufactured by American Steel Foundries as shown in U.S. Pat No. 3,716,146.

Figure 4:
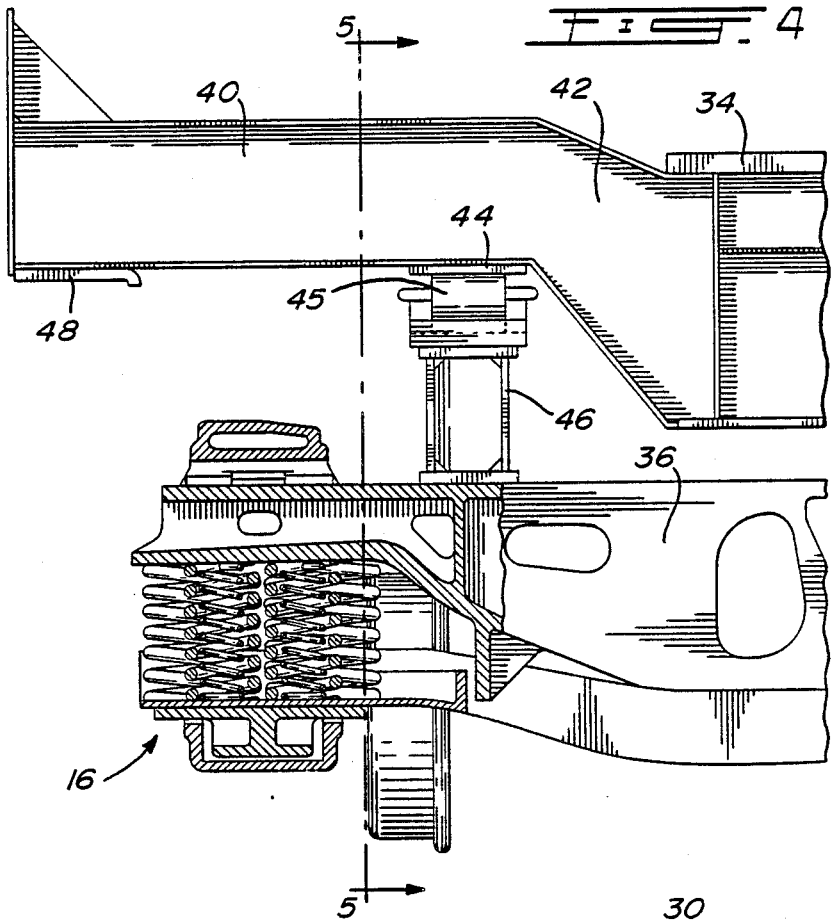
FIG. 4 shows an end view taken at line 4—4 of FIG. 2.

In the embodiment shown in FIGS. 3 and 4, end sills 40 extend perpendicularly from both sides of the raised ends 34 of the center sill 30. In the embodiment shown in FIGS. 4 and 5, the end sills 40 adjoining the articulated connection 18 each have a gull wing shape 42 adjacent the raised ends 34 of the center sill 30. The gull wing shape 42 extends from the center sill 30 in an upward plane and in an end plane towards the adjoining articulated connection 18. The body side bearing pads 44 are offset on the underside of the end sills 40. Truck side bearing pads 45 are positioned directly under the body side bearings 44 and are mounted on a side beam 46 located on the truck bolster 36. A small gap is provided between the body side bearing pads 44 and the truck side bearings 45 which closes when the car body tilts or rolls so the side loading is transferred directly to the truck assembly 16. Jacking pads 48 are positioned at the ends of the end sills 40 which extend out beyond the center truck assemblies 16 and permit jacking of the car body from outside the rail. The gull wing shape 42 of the end sills 40 are so shaped to avoid the wheels on the truck assemblies and to aid in reducing the height of the center sill 30.

Figure 8:
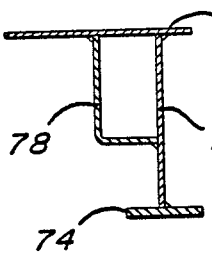
FIG. 8 shows a partial section taken at line 8—8 of FIG. 6.
Figure 6:
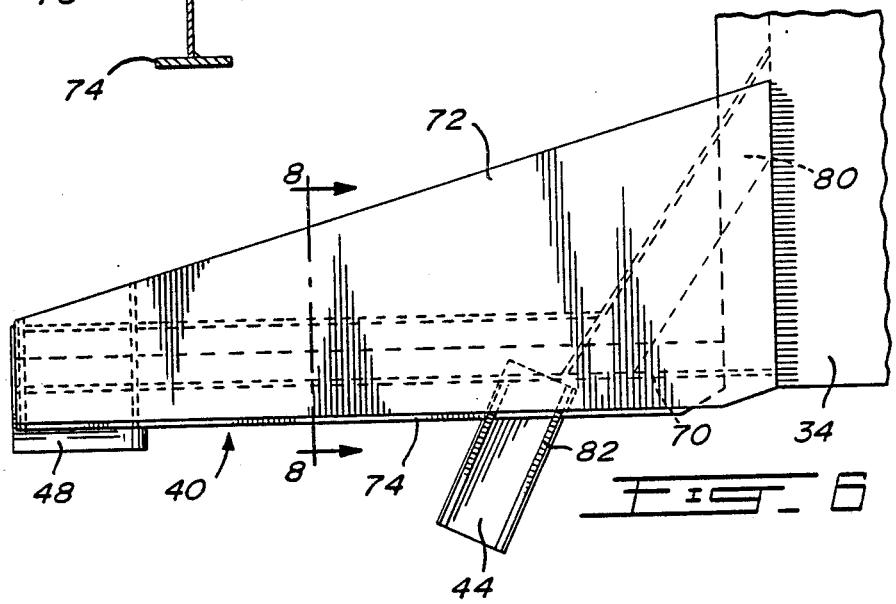
FIG. 6 shows a partial plan view of another embodiment of an end sill.
Figure 7:
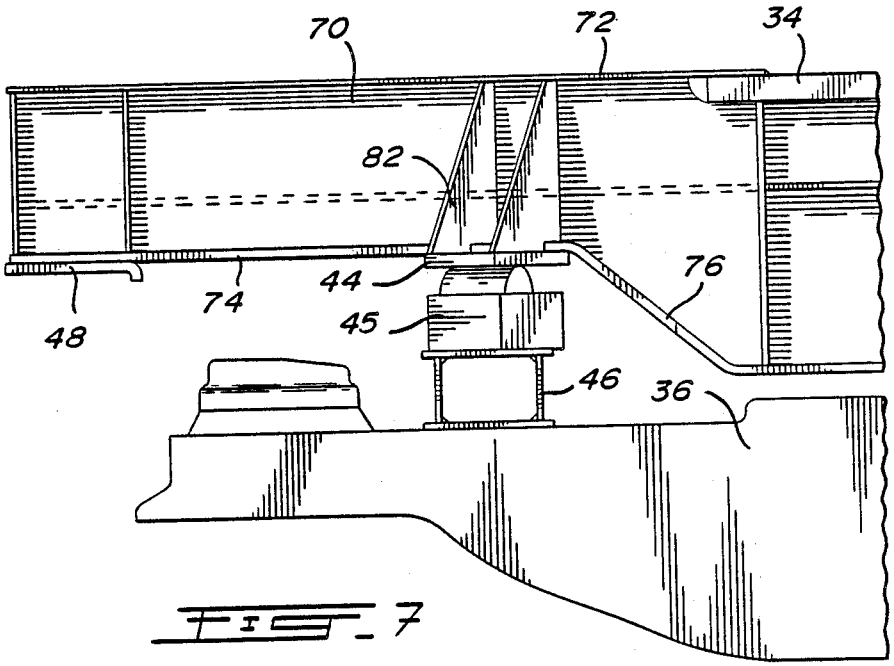
FIG. 7 shows a partial end view of the end sill shown in FIG. 6.

In another embodiment, shown in FIGS. 6, 7 and 8, the end sills 40 each have a vertical straight web 70 which extends perpendicularly out from the raised end 34 of the center sill 30. A tapered top plate 72 is flat and attached to the web 70. The top plate 72 is wide where it attaches to the top of the end sill 40 and narrow at the other end. A narrow thick bottom plate 74 is attached to the base of the web 70 and has a bend 76 so that it meets and is welded to the bottom flange of the end sill 34. An L-shaped stiffener 78 is welded to the underside of the top plate 72 and the web 70, and an angled L-shaped stiffener 80, also welded to the underside of the top plate 70, extends from the web 70 to the side of the end sill 34. Body side bearing plates 44 are angled outwards from the end sill 40, attached to the underside of the bottom plate 74 and having gusset plates 82 attached to the web 70 and underside of the top plate 72. This design of end sill has a top surface which is substantially the same level as the top of the raised ends 34 of the center sill 30.

Figure 9:
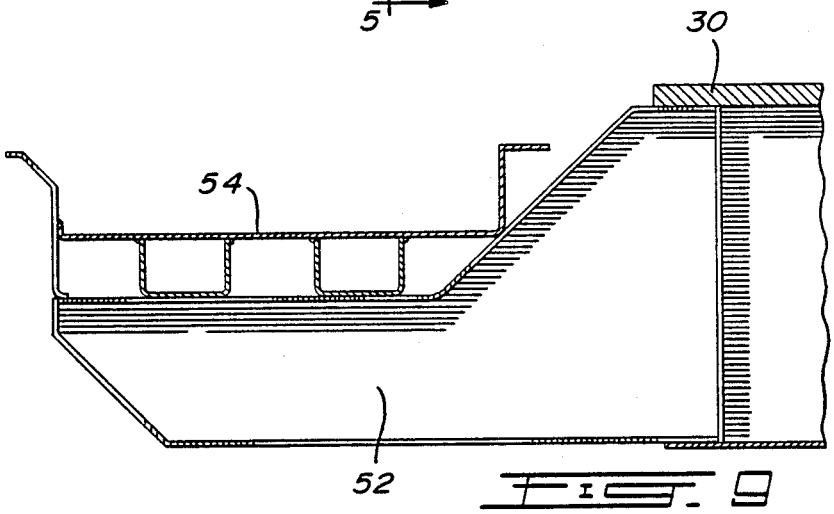
FIG. 9 shows a partial sectional view taken at line 6—6 of FIG. 2.

As can be seen in FIG. 9, the center sill 30 has a welded box structure with a heavier top plate than bottom plate. The top plate in the embodiment shown is twice the thickness of the bottom plate and has a greater sectional area than the bottom plate. Thus the centroid of the center sill 30 is as close to the coupling height of the railcar as possible in order to reduce bending stresses caused by eccentric axial loading.

Figure 2:
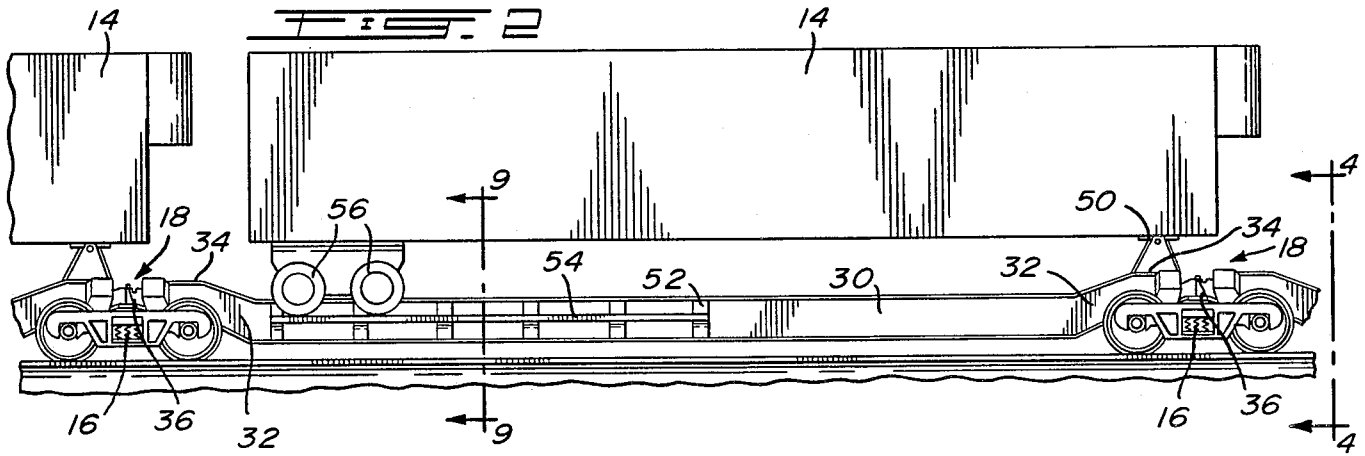
FIG. 2 shows a side view of a single car body.
Figure 5:
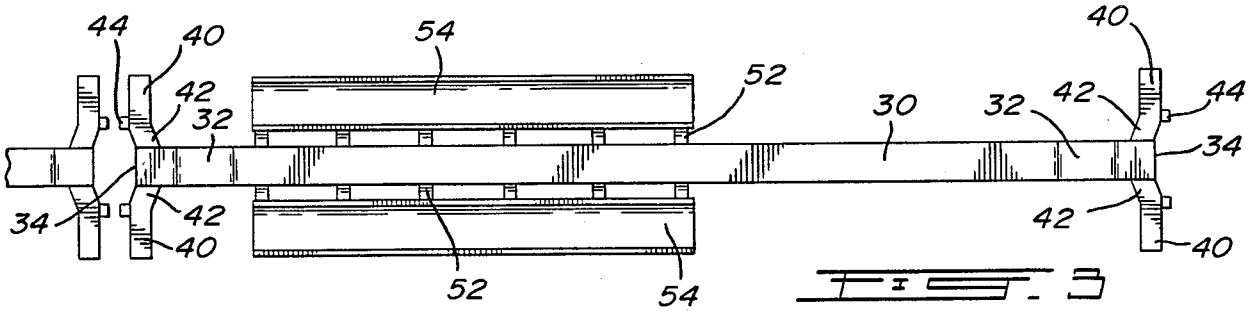

A hitch assembly 50 for a highway trailer 14 is positioned on one of the raised ends 34 of the center sill 30. The hitch assembly 50 is arranged to match with a king pin connection on the front of a highway trailer 14 as shown in FIG. 2. Cross bearers 52, as illustrated in FIG. 9 extend from both sides of the depressed center portion of the center sill 30 and support a plateform 54 on each side of the center sill 30 extending for a sufficient distance to support wheels 56 for different lengths and sizes of highway trailers 14. In one embodiment the platform 54 is 26 inches above the top of the rail which is approximately 18 inches below the deck of a typical flat car.

The highway trailers are lifted onto the car bodies 12 by means of an overhead crane and removed in the same manner. The trailer king pin is fitted to the hitch assembly 50 and locked in place. With the car platform 54 below the top of the depressed center portion of the center sill 30, the center of gravity of the highway trailer is kept low, as short a distance as possible above the top of the rail. In one embodiment, highway trailers having a weight up to forty five tons may be carried on a car body. This is considerably heavier than trailers permitted on existing piggyback railcars, which are generally restricted to weights of not more than thirty three tons.

Figure 10:
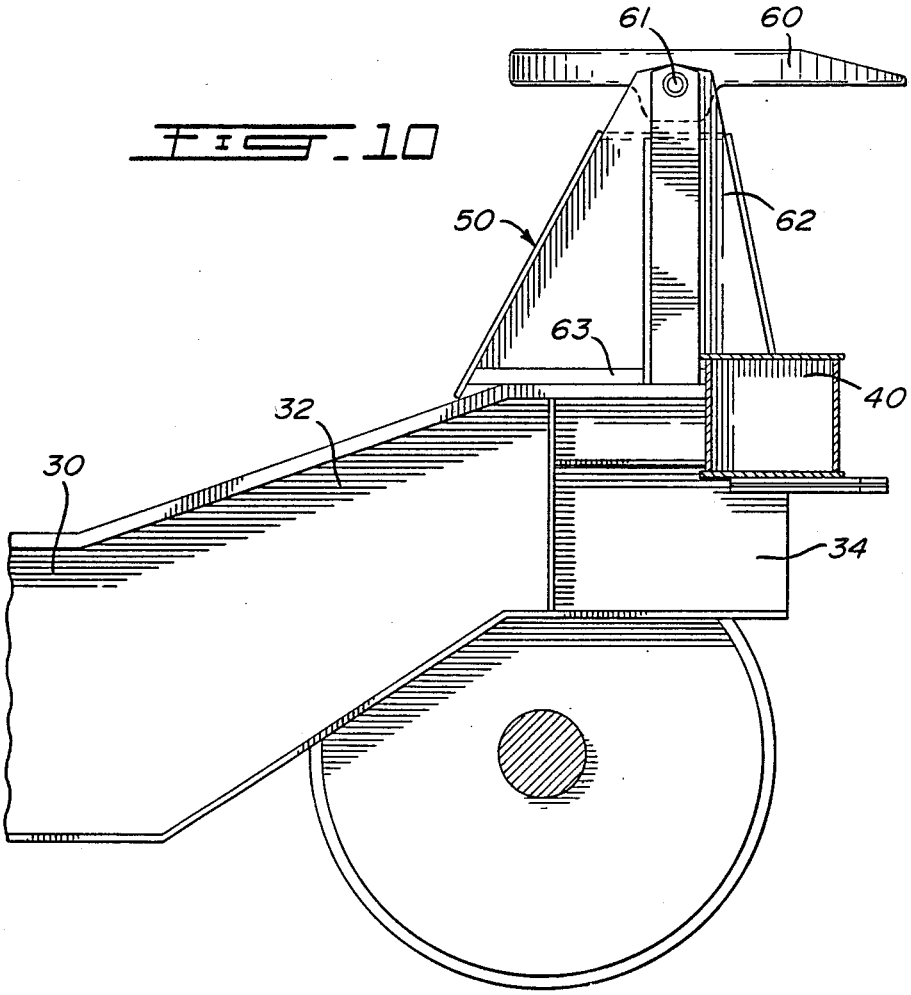
FIG. 10 shows a side view of a removable hitch assembly mounted on a car body.

The hitch assembly 50 comprises a hitch plate 60 which has a pivot connection 61 to a hitch frame 62. In the embodiment shown in FIG. 10, the hitch frame 62 has a bearing plate 63 which is mounted on the raised end 34 of the center sill 30 by means of bolts or other such fastening devices. By utilizing a removable hitch assembly 50, different locations may be provided on the center sill for mounting the assembly. Thus longer trailers may be mounted on each car.

Figure 11:
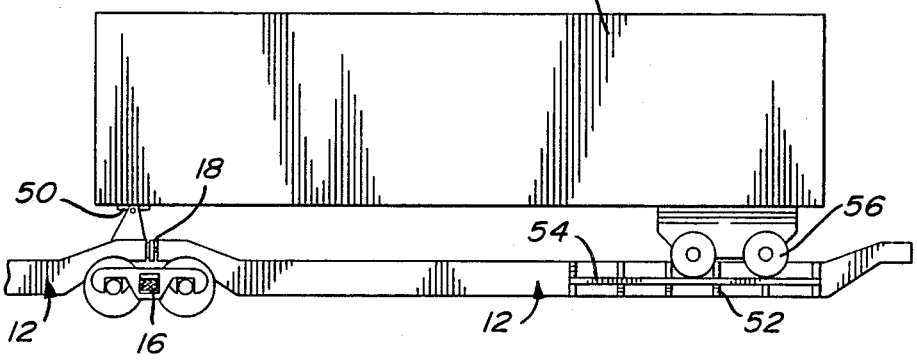
FIG. 11 shows a partial side view of an articulated railcar showing another arrangement for a highway trailer.

FIG. 11 illustrates how extra long highway trailers 14 can be carried on the articulated railcar. The hitch assembly 50 at one end of one car body 12 supports one end of the trailer 14, and the trailer wheels 56 rest on a support platform 54 of the adjacent car body 12. It is necessary to turn the hitch plate 60 the other way around in the frame 62 by removing the pivot connection 61 to allow the trailer king pin to be mounted from the other side. Whereas the support platform 54 is shown to extend for a portion of the length of the car body 12, it may extend for the whole length, or any portion of the length to accomodate variable lengths of road trailers. Hitch assemblies 50 may be provided at both ends of the car body 12 to take into account trailer mountings such as those shown in FIGS. 1 and FIG. 6.

Various changes may be made to the embodiments shown herein without departing from the scope of the present invention which is limited only by the following claims.

The embodiments of the invention in which an exclusive property or privilege is claimed are defined as follows:

1. An articulated railcar comprising:

a plurality of car bodies positioned end to end with articulated connections therebetween, each car body having a skeleton structure with a depressed center sill extending centrally for the length of the car body, the center sill having goose neck projections at each end, with the ends of the center sill at a higher elevation than the remainder of the center sill, end sills at each end of the center sill extending perpendicularly from each side of the center sill, the end sills adjoining the articulated connections, body side bearing pads located on the underside of each of the end sills, the body side bearing pads offset longitudinally from a plane representing the end of the center sill towards the adjoining articulated connection, the end sills extending outwards on eac side to jacking positions located outside rails on which the railcar is supported, a single double axle truck assembly including a bolster having a center pin thereon disposed between adjacent ends of car bodies, the articulated connections including connector means on each end of each car body for engagement with the center pin on the adjacent truck assembly whereby each car body has a single point suspension at each end thereof, truck side bearings on each said truck assembly, said truck side bearings being disposed beneath said body side bearing pads with a small gap therebetween whereby, when the car body tilts, the side bearing pad engages the truck side bearing to transfer the side loading directly to the truck assembly.

2. The railcar according to claim 1 wherein the end sills each have a gull wing shape extending from the center sill in an upward plane, and in an end plane towards the adjoining articulated connection.

3. The railcar according to claim 1 wherein the end sills each comprise a straight web extending from each end of the center sill, the web having a top plate and a bottom plate bent to meet the center sill bottom, and each of the body side bearing pads extend at an angle from beneath the bottom plate over the truck side bearings.

4. The railcar according to claim 1 wherein the car bodies are adapted to support highway trailers and include a hitch assembly above one end of the center sill, and a trailer wheel platform supported on cross bearers attached to both sides of the center sill, the platform being below the top of the center sill.

5. The railcar according to claim 4 wherein the hitch assembly is removable and can be fitted to either end of the center sill.

6. The railcar according to claim 4 wherein the hitch assembly is removable and can be fitted to at least one predetermined location on the center sill.

7. The railcar according to claim 4 wherein a highway trailer is connected to the hitch assembly on one car body and the trailer wheel platform of the adjacent car body.

8. The railcar according to claim 4 wherein three or five car bodies are joined together with articulated connections between the adjoining ends of the car bodies.

9. The railcar according to claim 1 wherein the center sill comprises a welded box structure with a top plate having a greater sectional area than a bottom plate, such that the center sill has a centroid located as close to coupling height of the railcar as possible.

* * * * *